United States Patent [19]

Pitel et al.

[11] 3,952,915

[45] Apr. 27, 1976

[54] DELIVERY UNIT FOR HELICAL FEED MERCHANDISING MACHINE

[75] Inventors: Irving Pitel, Edison; Richard S. Silverman, Springfield; Richard J. Mueller, Mountain Lakes, all of N.J.

[73] Assignee: Rowe International, Inc., Whippany, N.J.

[22] Filed: Mar. 22, 1974

[21] Appl. No.: 453,885

[52] U.S. Cl. ..... 221/75

[51] Int. Cl.[2] ..... G07F 11/36

[58] Field of Search ..... 221/75; 198/213; 312/35; 222/413

[56] References Cited

UNITED STATES PATENTS

| | | | |
|---|---|---|---|
| 2,818,165 | 12/1957 | Dupps | 198/213 |
| 3,335,907 | 8/1967 | Holstein et al. | 221/75 X |
| 3,653,540 | 4/1972 | Offutt | 221/75 |
| 3,715,055 | 2/1973 | Kendrick et al. | 221/75 |
| 3,840,147 | 10/1974 | O'Neal et al. | 221/75 |

*Primary Examiner*—Robert B. Reeves
*Assistant Examiner*—Francis J. Bartuska
*Attorney, Agent, or Firm*—Shenier & O'Connor

[57] ABSTRACT

A candy bar delivery unit for a helical feed merchandising machine in which an article-advancing helix, having an article-delivery cam formed at the front end thereof, is supported above the bottom of the delivery shelf between an elongated boss extending from front to back of one side wall of the unit and the other side wall of the unit so that the turns of the helix make substantially point contact with the boss and with the other side wall and in which drive means is energized on each operation of the unit to rotate the helix through a single revolution to cause the turns of the helix to advance articles supported on end on the shelf between the turns of the helix and to cause the helix cam to deliver the leading article over the front edge of the shelf. Each side wall is provided with an inwardly directed retainer tab for holding the helix in position. Owing to the fact that the helix is supported above the shelf, the helix engages the product at the top and bottom of the helix to ensure delivery of the product. When the product reaches the front of the helix adjacent to the edge of the shelf the cam kicks the lower end of the product outwardly over the shelf edge while restraining the upper end of the product to prevent tumbling of the product as it is delivered over the shelf edge.

17 Claims, 5 Drawing Figures

FIG 4
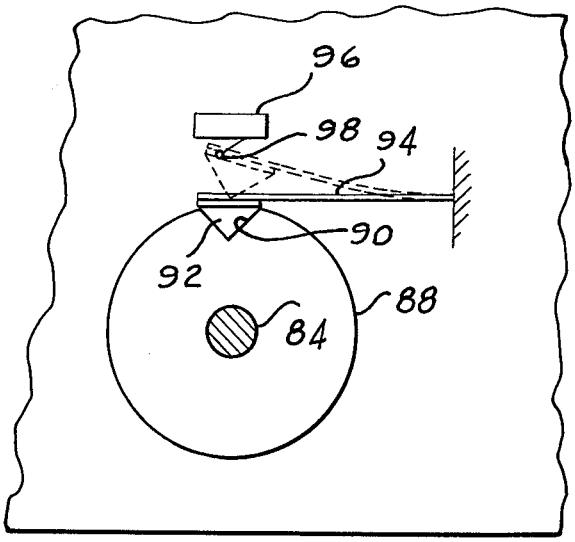
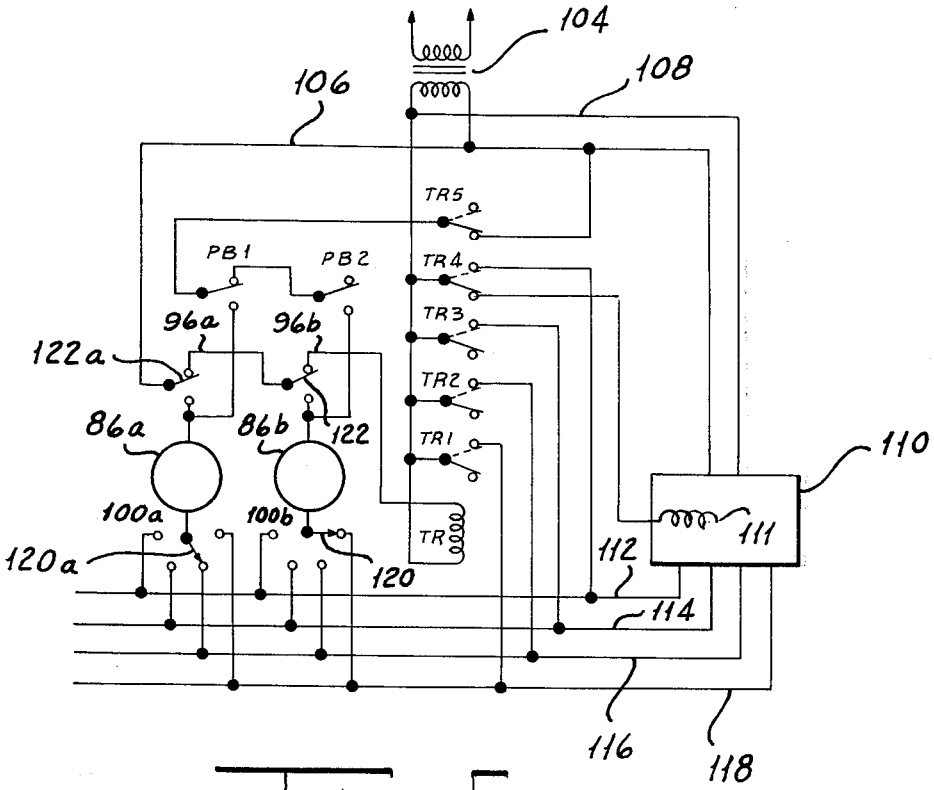
FIG 5

DELIVERY UNIT FOR HELICAL FEED MERCHANDISING MACHINE

BACKGROUND OF THE INVENTION

There are known in the prior art merchandising machines in which articles to be dispensed are disposed between the turns of one or more helices which are rotated in the course of a dispensing operation to advance the articles and to deliver one of the articles to a customer. Most of these machines are designed to dispense merchandise in bags. For example, bags of snacks such as potato chips and the like are adapted to be delivered by this means.

It is desirable that a merchandising machine of the type described above, which is primarily designed to dispense bagged merchandise, also have the capability of delivering other articles such, for example, as bars of candy or the like. Unfortunately, the units which are adapted to deliver merchandise in bags do not easily handle bars of candy and the like. Attempts have been made in the prior art to modify the delivery units so as to enable them to handle articles of merchandise such as bars of candy. Such attempts have generally been unsuccessful. First, loading of existing units with bars of candy consumes an inordinate amount of space for the size of the article being delivered. Secondly, the units adapted to handle bags do not readily accommodate candy bars so that jamming of the delivery mechanism may occur. Attempts to modify the mechanism to permit the delivery of bars likewise have resulted in arrangements which are likely to jam owing to the difficulty of handling the bar with a helical feeder.

We have developed a delivery unit for a helical feed merchandising machine which unit is especially adapted to handle articles such as bars of candy. Our unit has a relatively high capacity for the space occupied thereby. Our unit successfully delivers articles such as bars of merchandise without jamming. It is certain in operation. It is simple in construction for the result achieved thereby. It is readily adapted for use with other units which are designed to deliver merchandising bags or to deliver articles such as packets of gum and mints.

SUMMARY OF THE INVENTION

One object of our invention is to provide a delivery unit for a helical feed merchandising machine which unit is especially adapted to deliver articles such as bars of candy.

Another object of our invention is to provide a candy bar delivery unit for a helical feed merchandising machine which has a relatively large capacity for the space occupied thereby.

Another object of our invention is to provide a candy bar delivery unit for a helical feed merchandising machine which minimizes the possibility of jamming.

A further object of our invention is to provide a candy bar delivery unit for a helical feed merchandising machine which is certain in operation.

Another object of our invention is to provide a candy bar delivery unit for a helical feed merchandising machine which is simple in construction for the result achieved thereby.

Other and further objects of our invention will appear from the following description.

In general our invention contemplates the provision of a candy bar delivery unit for a helical feed merchandising machine in which an article advancing helix having a delivery cam formed at the front thereof is rotatably supported above the bottom of a delivery shelf between an inwardly directed elongated boss extending from front to back of one side wall of the unit and the other side wall of the unit so that the turns of the helix make substantially point contact with the boss and with the other side wall and in which a one-revolution drive system is energized on each operation of the unit to rotate the helix to advance articles supported on end on the shelf between the turns of the helix and to cause the delivery cam to advance the leading article over the front edge of the shelf. We provide each of the side walls with an inwardly directed retainer tab for holding an adjacent helix on the shelf.

BRIEF DESCRIPTION OF THE DRAWINGS

In the accompanying drawings which form part of the instant specification and which are to be read in conjunction therewith and in which like reference numerals are used to indicate like parts in the various views:

FIG. 4 is a fragmentary sectional view of the candy bar delivery unit illustrated in FIG. 2 taken along the line 4—4 thereof.

FIG. 5 is a schematic view illustrating one form of electrical circuit which can be used to control our candy bar delivery unit for a helical feed merchandising machine.

DESCRIPTION OF THE PREFERRED EMBODIMENT

Figure 1:
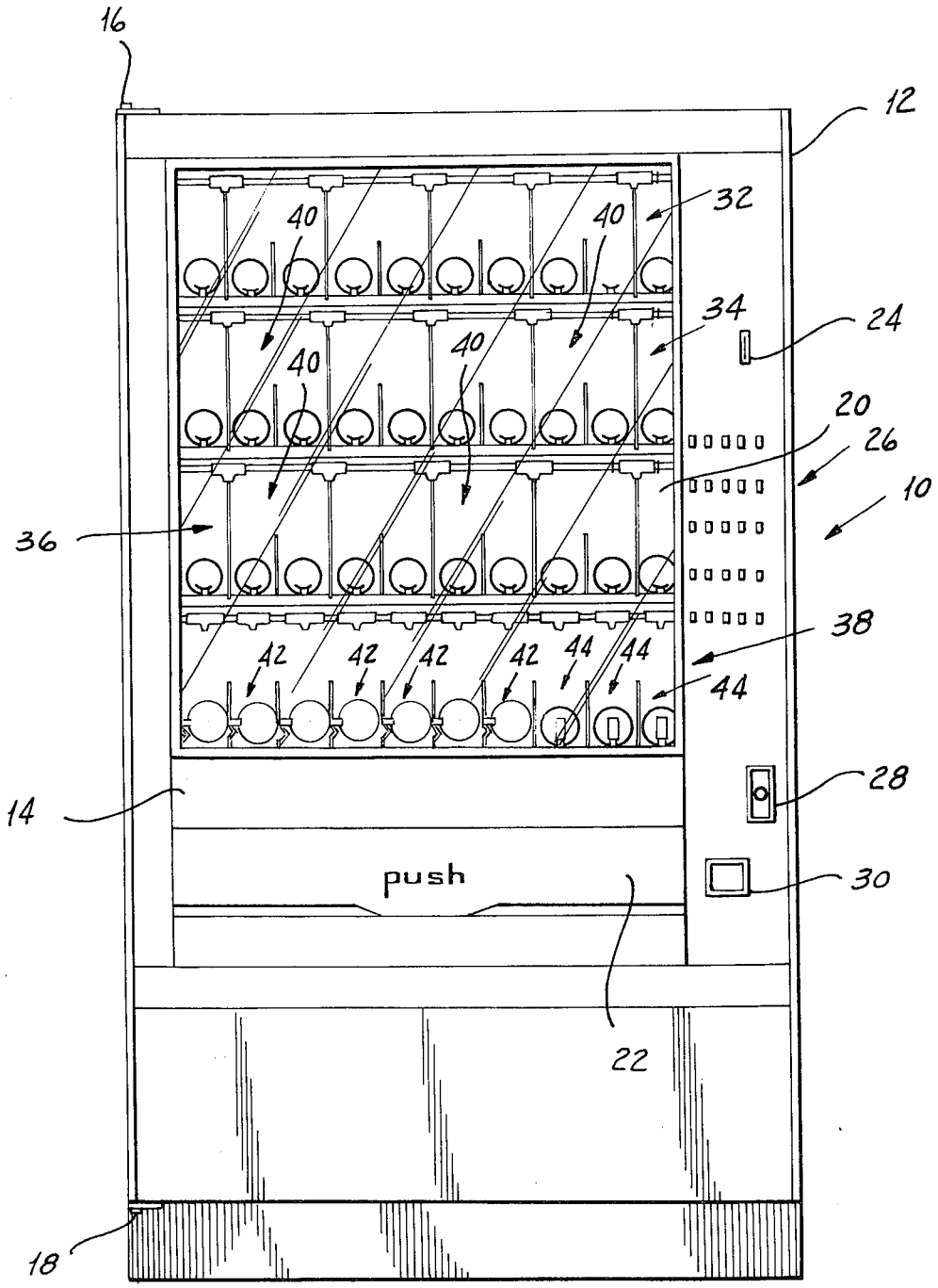
FIG. 1 is a front elevation of a helical feed merchandisng machine which may include a number of our candy bar delivery units.
Figure 2:
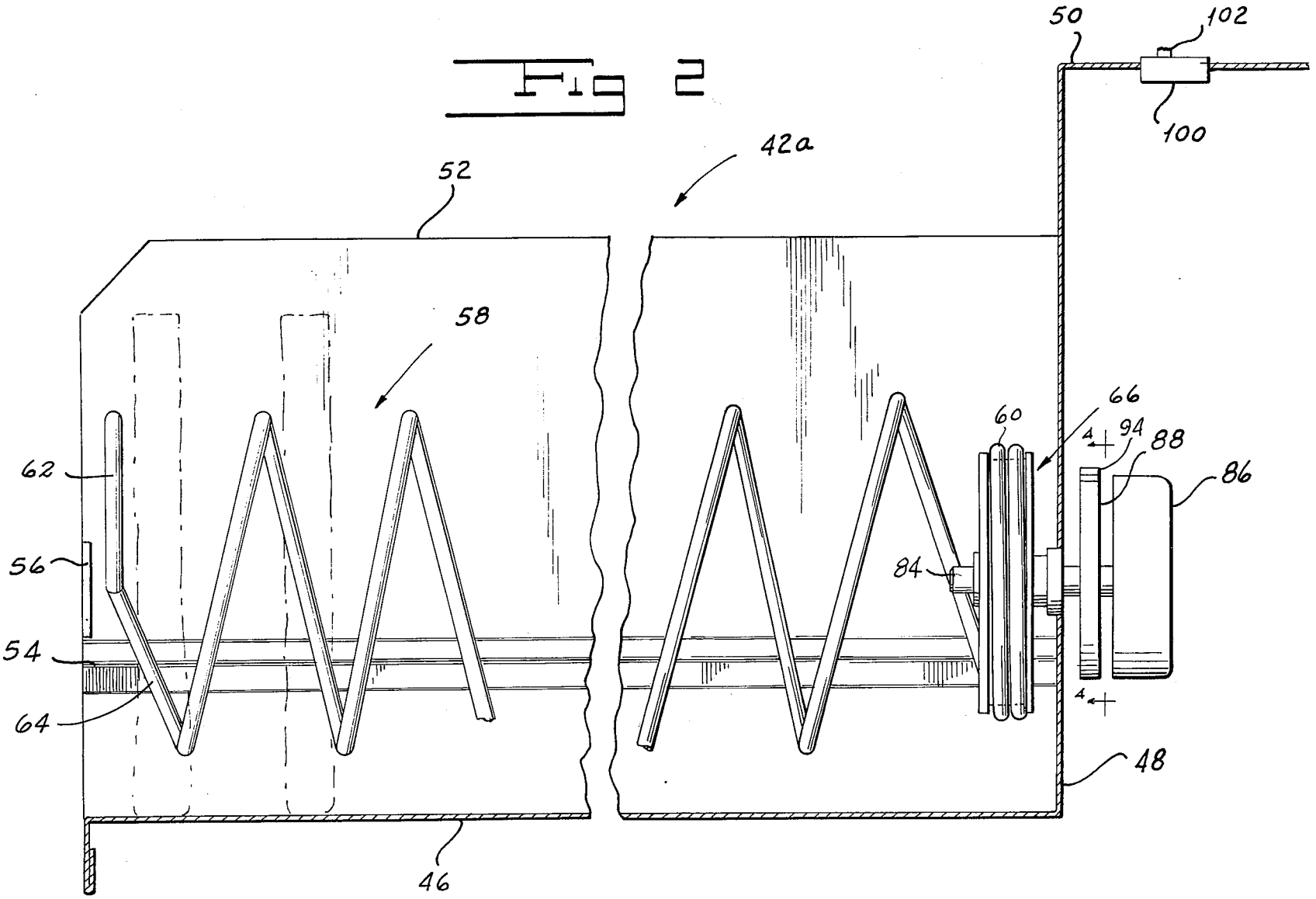
FIG. 2 is a sectional view of a candy bar delivery unit included in one of the shelves of the merchandising machine illustrated in FIG. 1.

Referring now to the drawings, a merchandising machine, indicated generally by the reference character 10, which may include one or more of our candy bar delivery units to be described hereinbelow, includes a cabinet 12, having a door 14 supported on the cabinet by means of hinges 16 and 18. We provide the door 14 with a window 20 through which merchandise to be delivered can be viewed by the customer. A delivery door 22 in the main door 14 affords access to an article of merchandise to be delivered to a customer.

We also provide the door 14 with a coin slot 24 through which coins can be introduced into the coin mechanism of the machine. The push buttons of an array 26 of push buttons are adapted selectively to be actuated to energize one of the delivery units of the machine when a sum aggregating the purchase price of an article has been inserted through the slot 34. The door 14 also is provided with a lock 28 of the conventional type for securing it in a closed position on the cabinet 12. A suitable receptacle 30 is provided for permitting change in coins to be returned to the customer.

The particular embodiment illustrated in FIG. 1 includes four merchandising levels indicated generally respectively by the reference characters 32, 34, 36 and 38. All of the levels 32, 34 and 36 may include the same type of delivery units indicated generally by the reference character 40 for delivering articles of merchandise such, for example, as bagged merchandise. These delivery units, as well as many of the other features of the machine 10, are described in detail in our copending application Ser. No. 454,118 filed Mar. 25, 1974, for Helical Feed Merchandising Machine. The lowest level 38 of the machine may include a number of units indicated generally by the reference character 44 adapted to deliver articles such, for example, as packets of gum and mints. These units 44 are more fully described in our copending application Ser. No. 453,886, filed Mar. 22, 1974 for Gum and Mint Delivery Unit for Helical Feed Merchandising Machine. Level 38 also includes a plurality of our candy bar delivery units indicated generally by the reference character 42.

Each of the units 42 includes a portion of a shelf 46 having a back wall 48 and a top flange 50. The shelf may be slidably supported in the cabinet 14 in the manner described in our copending application for Helical Feed Merchandising Machine referred to hereinabove. We provide the portion of the shelf 46 adapted to make up the candy bar delivery units 42 with a plurality of spaced partitions 52 each of which is formed with an inwardly directed boss 54 extending from front to back of the partition and located at a predetermined distance above the bottom of the shelf 46. In addition, each of the partitions 52 is formed with a retainer tab 56 the function of which will be described in more detail hereinbelow.

Each unit 42 includes a helix, indicated generally by the reference character 58, provided with a pair of turns 60 of reduced diameter at the rear thereof. We form the first 180° of the helix 58 at the front thereof with zero pitch. We have indicated this portion of the helix by the reference character 62. The next 90° of the helix indicated by the reference character 64 is formed with a greater pitch than the remaining turns of the helix, so that the distance between the terminus of this 90° section and a corresponding point on the preceding turn is one and one-half times the distance between corresponding points on adjacent normal turns of the helix. As will be more fully pointed out, this arrangement provides a cam which ensures that the leading article is delivered off the front edge of the shelf 46 when the helix 58 is driven.

The closely spaced reduced diameter turns 60 at the rear of the helix are carried by a spider indicated generally by the reference character 66. Spider 66 includes a hub 68 and a plurality of resilient arms 70, 72, 74 and 76. Arms 70 and 72 extend outward to a connector 78 while the arms 74 and 76 extend outwardly to a connector 80. We provide the connectors 78 and 80 with a pair of spaced fingers 82 formed with grooves for receiving the turns 60 of the helix. We form an inwardly diverted tail 61 at the back of each helix. This tail is adapted to be engaged by the bend connecting arm 70 to connector 78 to ensure that the helix turns with the spider and prevents slippage therebetween. It will readily be appreciated that, owing to the inherent resiliency of the arms 70, 72, 74 and 76, the turns 60 can be snapped into position on the fingers 82. The hub 68 of the helix is carried for rotation with a shaft or rotatably supported in the back 48 of the panel 46. The space between adjacent panels 52, the inward extent of the boss 54, the diameter of the helix 58 and the location of shaft 84 in the back panel 48 are so selected that the helix 58 is rotatably supported at a location above shelf 46 with the turns of the helix making substantially point contact with the edge of the boss 54 and with the surface of the wall 52 remote from the boss with which the helix is associated. With this configuration, the turns of the helix are adapted to receive therebetween articles such as bars of candy resting on end on the surface of the shelf 46. Tabs 56 prevent the forward ends of the helical members 58 from extending over the shelf edge in such a way that they might interfere with a product dropping from above. Moreover we incline the upper edges of tabs 56 downwardly so that a dropping product will not hang up on a tab.

We provide a respective motor and gearbox assembly 86 for driving each of the shafts 84. The output shaft of the motor and gearbox 86 which may be shaft 84 carries for rotation therewith a cam 88 formed with a recess 90. A detent 92 carried by a spring arm 94, is urged into engagement with the periphery of cam 88 by the resilience of the arm 94. We so select the spring strength of the arm that in engaging the recess 90, the detent 92 exerts a centering action on the helix 58. Moreover, we so shape the detent and recess as to require a predetermined angular revolution of the shaft 84 such, for example, as a revolution of 10° before the spring arm engages the actuator 98 of a one revolution switch 96.

We mount a price selecting switch 100 on the flange 50 at the rear of each of the units 42. Each switch 100 has an actuator 102 adapted to be moved among four positions so that the articles can be sold at four different prices.

Referring now to FIG. 5, one form of electrical circuit which may be used to control the operation of our candy bar delivery unit includes a transformer 104 adapted to supply power to a pair of conductors 106 and 108. Connectors 106 and 108 provide a source of power for a coin mechanism 110 of a type known in the art which includes a coin return electromagnet 111. Register 110, moreover, includes a plurality of output price lines 112, 114, 116 and 118 which are energized at various levels of money deposited in the register 110. Each of the price selecting switches 100 includes a movable contact 120 adapted selectively to be engaged with one of four contacts connected respectively to the price lines 112, 114, 116 and 118. We connect each of the movable contacts 120 to one of the motors 86 associated with one of the delivery units. Each of the one revolution switches 96 includes a movable contact 122 which normally engages the upper one of a pair of contacts illustrated in FIG. 5 and which is adapted to be moved into engagement with the lower contact by the action of the detent 92 under the influence of cam 88 to provide a holding circuit for the associated motor 86. We connect the switches 122 in series between conductor 106 and a transfer relay winding TR connected to line 108 so that the relay winding TR normally is energized when power is on.

Figure 3:
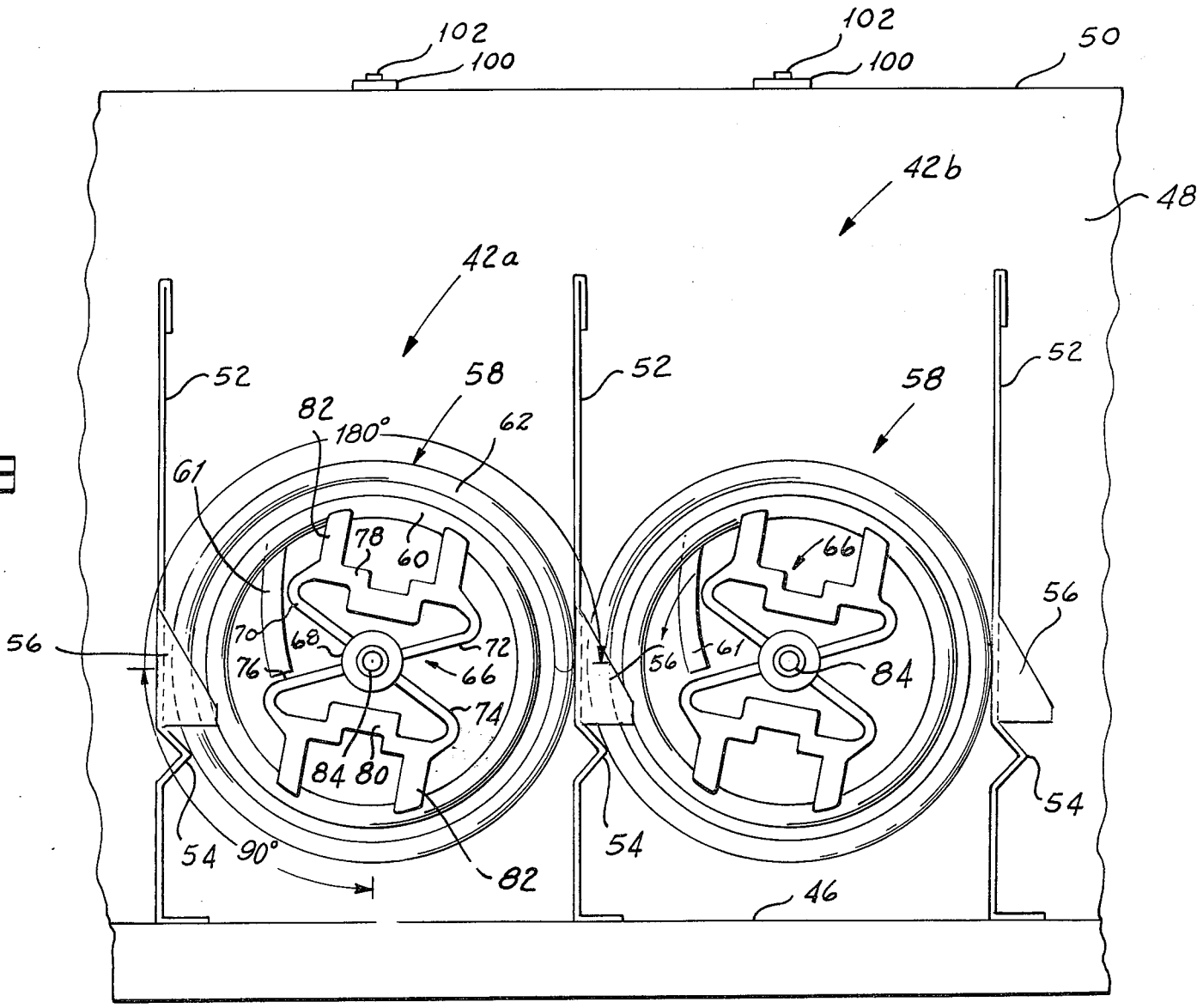
FIG. 3 is a fragmentary front elevation of a portion of one of the shelves of the machine shown in FIG. 1 illustrating a pair of our candy bar delivery units.

When energized the relay winding TR holds its associated switches TR1 to TR5 in the positions shown in FIG. 3 with the moveable contact in engagement with the lower of the pair of contacts associated therewith. Thus, line 108 is connected to TR4 and power is supplied to coin return electromagnet 111 of the coin mechanism 110 to condition the mechanism to accept coins. When a sum in coins aggregating the purchase price of an article has been deposited in the mechanism 110, the customer actuates one of the push buttons PB1 or PB2 to energize the corresponding motor 86 which, after a predetermined revolution thereof, moves the associated switch arm 122 into the lower of the two contacts illustrated in FIG. 5 to break the circuit of winding TR. When that occurs, the associated switches move to the broken line positions shown in FIG. 5 to disable the coin return electromagnet 111 and to disable the push buttons and to remove the credit.

In operation of our candy bar delivery unit for a spiral feed merchandiser, the customer actuates a push button in the manner described above to make a selection after having deposited sufficient money in the coin mechanism 10. As the shaft 84 goes through one revolution the cam formed by the portions 62 and 64 of the helix at the front thereof kicks the lower end of the product off the shelf edge, while restraining the upper end of the product so that the product drops to the delivery area without tumbling. At the same time, the remaining bars are advanced along the shelf 46. In advancing the bars, the helix, owing to the fact that it is supported above the shelf engages the bars at the top and bottom of the helix.

It will be seen that we have accomplished the objects of our invention. We have provided a delivery unit which is especially adapted to deliver articles such as bars of candy on a helical feed merchandising machine. Our delivery unit is certain in operation. It is not likely to jam. It is relatively simple in construction for the result achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A delivery unit for feeding articles to the delivery area of a merchandising machine including in combination, a generally horizontally disposed shelf, a pair of side walls extending from front to back of said shelf, a single helical delivery member formed with a plurality of turns, means on said side walls at locations spaced vertically from said shelf for rotatably supporting outer surface portions of the turns of said helical member on both sides of the longitudinal axis thereof to support said delivery member above the surface of said shelf with the turns thereof spaced vertically from the surface of said shelf throughout the length of said member and with said member extending generally from front to back of said shelf, at least the central portions of the spaces between adjacent turns of said helical member being free of obstructing structural members and said helical member being spaced above said shelf by such a distance that an article supported by said shelf at one of said central locations extends below the lower portions of the turns of said helix into engagement with said shelf and above the upper portions of the turns of said helical member to cause said lower portions of the turns of said helix to engage an article above the bottom thereof and said upper portions of the turns of said helical member to engage an article below the top thereof and means for rotating said member to advance the leading article over the front edge of said shelf.

2. A delivery unit as in claim 1 in which said articles are elongated, said articles being supported on end on said shelf between said turns.

3. A delivery unit as in claim 1 in which said rotating means rotates said member through one revolution on each operation of said machine.

4. A delivery unit as in claim 1 in which said delivery member includes a cam at the front thereof for advancing the leading article over the front edge of said shelf in response to rotation of said delivery member.

5. A delivery unit as in claim 4 in which said cam comprises a portion of said helical member having a pitch greater than the normal pitch of said member.

6. A delivery unit as in claim 5 in which said portion extends over approximately 90°.

7. A delivery unit as in claim 1 in which said delivery member comprises a zero pitch portion extending over approximately 180° from the front terminus of the member and a portion having a pitch which is greater than the normal pitch of the member extending over approximately 90° from said zero pitch portion to the remainder of said member.

8. A delivery unit as in claim 7 in which said front terminus is to one side of said unit in the rest position of said member.

9. A delivery unit as in claim 1 in which said supporting means comprises spaced side walls carried by said shelf, an inwardly projecting delivery member support running along one of said walls at a location above said shelf, said delivery member resting on said support and against the other wall.

10. A delivery unit as in claim 9 in which said support is a rib formed in said wall.

11. A delivery unit as in claim 1 in which said unit comprises a pair of side walls carried by said shelf and a member retainer extending inwardly from the forward edge of one of said walls.

12. A delivery unit for feeding elongated articles to the delivery area of a merchandising machine including in combination, a generally horizontally disposed article supporting shelf having a front edge, a pair of spaced side walls extending from front to back of said shelf, a single helical delivery member formed with a plurality of turns adapted to receive articles therebetween, means on said side walls at locations spaced vertically from said shelf for rotatably supporting outer surface portions of the turns of said helical member on both sides of the longitudinal axis thereof to support said member above the surface of said shelf, and with the turns thereof spaced vertically from the surface of said shelf throughout the length of said member, with the member extending generally from front to back of said shelf, at least the central portion the spaces between adjacent turns of said helical member being free to obstructing structural members and said helical member being spaced above said shelf by such a distance that an article supported by said shelf at one of said central locations extends below the lower portions of the turns of said helix into engagement with said shelf and above the upper portions of the turns of said helical member to cause said lower portions of the turns of said helix to engage an article above the bottom thereof and said upper portions of the turns of said helical member to engage an article below the top thereof, means for rotating said helical member to advance said articles along said shelf toward said front edge and a cam at the front of said member for advancing the leading article over the front edge of said shelf in response to rotary movement of said member.

13. A delivery unit as in claim 12 in which said supporting means comprises a rib extending along one of said side walls at a location spaced above said shelf.

14. A delivery unit as in claim 12 in which said cam comprises a portion of said helical member having greater pitch than the normal pitch of said member.

15. A delivery unit as in claim 12 in which said rotating means rotate said member one revolution on each operation of said machine.

16. A delivery unit as in claim 12 in which said supporting means comprises a rib on one of said sides at a location spaced above said shelf and in which said cam comprises a portion of said member having a greater pitch than the normal pitch of the member.

17. A delivery unit as in claim 16 including a delivery member retaining tab extending inwardly from the front edge of one of said side walls.

* * * * *